US012104293B2

(12) United States Patent
Engesser

(10) Patent No.: US 12,104,293 B2
(45) Date of Patent: Oct. 1, 2024

(54) METHOD FOR PATTERN-DIRECTED FORMATION OF THE CONNECTION POINT OF AN EFFECT THREAD IN THE WOVEN FABRIC

(71) Applicant: Textilma AG, Stansstad (CH)

(72) Inventor: Bernhard Engesser, Niederwil (CH)

(73) Assignee: Textilma AG (CH)

( * ) Notice: Subject to any disclaimer, the term of this patent is extended or adjusted under 35 U.S.C. 154(b) by 246 days.

(21) Appl. No.: 17/602,154

(22) PCT Filed: Apr. 7, 2020

(86) PCT No.: PCT/EP2020/059942
§ 371 (c)(1),
(2) Date: Mar. 29, 2022

(87) PCT Pub. No.: WO2020/208045
PCT Pub. Date: Oct. 15, 2020

(65) Prior Publication Data

US 2023/0096264 A1 Mar. 30, 2023

(30) Foreign Application Priority Data

Apr. 10, 2019 (EP) ..... 19168490

(51) Int. Cl.

| | |
|---|---|
| ***D03D 13/00*** | (2006.01) |
| ***D03D 1/00*** | (2006.01) |
| ***D03D 15/00*** | (2021.01) |
| ***D03D 15/25*** | (2021.01) |
| ***D03D 15/50*** | (2021.01) |
| ***D06H 7/04*** | (2006.01) |
| *D03D 25/00* | (2006.01) |

(52) U.S. Cl.
CPC ..... *D03D 15/00* (2013.01); *D03D 1/0088* (2013.01); *D03D 13/00* (2013.01); *D03D 15/25* (2021.01); *D03D 15/50* (2021.01); *D06H 7/04* (2013.01); *D10B 2401/16* (2013.01)

(58) Field of Classification Search
CPC ..... D03D 15/00; D03D 1/0088; D03D 13/00; D03D 15/25; D03D 15/50; D03D 13/004; D03D 15/533; D03D 13/002; D03D 21/00; D03D 15/49; D06H 7/04; D10B 2401/16; D10B 2101/20; D10B 2403/0243; D10B 2403/02431
See application file for complete search history.

(56) References Cited

U.S. PATENT DOCUMENTS

| | | | | | |
|---|---|---|---|---|---|
| 1,098,081 | A * | 5/1914 | Baum | D02G 3/365 | 57/12 |
| 1,158,391 | A * | 10/1915 | Ringe | D05B 3/02 | 112/98 |
| 1,384,519 | A * | 7/1921 | De Voe | D05B 35/02 | 112/122 |
| 1,707,068 | A * | 3/1929 | Rubel | D05B 3/02 | 112/100 |
| 2,250,689 | A * | 7/1941 | Weaver | D07B 3/106 | 57/15 |
| 2,450,429 | A * | 10/1948 | Henning | H01B 7/04 | 57/212 |
| 2,509,372 | A * | 5/1950 | Seifried | D02G 3/322 | 57/16 |
| 2,598,426 | A * | 5/1952 | Peterson | D05B 71/00 | 184/11.1 |
| 2,729,176 | A * | 1/1956 | Smith | D05B 3/02 | 112/245 |
| 3,908,708 | A * | 9/1975 | Nogai | D03D 35/00 | 139/431 |
| 4,244,199 | A * | 1/1981 | Rhode | D04B 21/18 | 66/193 |
| 4,410,015 | A * | 10/1983 | Koller | D03D 41/00 | 245/10 |
| 5,517,933 | A * | 5/1996 | Karaba, Jr. | D05B 53/00 | 112/475.26 |
| 5,720,323 | A * | 2/1998 | Tremer | D03D 3/04 | 139/1 R |
| 6,273,149 | B1 * | 8/2001 | Dewispelaere | D03D 39/08 | 139/21 |

(Continued)

FOREIGN PATENT DOCUMENTS

| | | |
|---|---|---|
| CH | 490541 A | 5/1970 |
| DE | 10 2010 026 609 B3 | 11/2011 |

(Continued)

OTHER PUBLICATIONS

Written Opinion and International Search Report in related PCT/EP2020/059942.

*Primary Examiner* — Robert H Muromoto, Jr.
(74) *Attorney, Agent, or Firm* — George Pappas Barrett McNagny LLP

(57) ABSTRACT

For a woven fabric (20) with an additional thread (30, 34) laid out in a zigzag shape, in order to ensure in certain cases that the zigzag thread (30, 34) has its zigzag tip (38) always at the same position over the length of the woven fabric, it is proposed that the weft thread (24) is introduced at certain points in the woven fabric (20) in a floating manner over a plurality of adjacent warp threads (21) and that the feed needle (32, 36) is introduced or inserted into the woven fabric (20) at least at one side of the zigzag laid cover thread (30, 34) at several laying points or at all laying points where the weft thread (24) is floating over several adjacent warp threads (21). The cover thread (30, 34) is positioned at the inside of the zigzag shape.

20 Claims, 9 Drawing Sheets

(56) References Cited

U.S. PATENT DOCUMENTS

| | | | | |
|---|---|---|---|---|
| 6,289,941 | B1 * | 9/2001 | Debaes | D03D 27/10 139/21 |
| 8,333,222 | B2 * | 12/2012 | Leppla | D03D 35/00 139/192 |
| 10,550,498 | B2 * | 2/2020 | Hofstetter | D03D 13/004 |
| 2009/0149098 | A1 * | 6/2009 | Andronis | D03D 1/0088 296/70 |
| 2013/0118633 | A1 * | 5/2013 | Studer | D03D 35/00 139/11 |
| 2015/0354106 | A1 * | 12/2015 | Beauduin | D03D 27/06 139/116.5 |
| 2016/0083875 | A1 * | 3/2016 | Thiel | D03D 41/00 139/11 |
| 2016/0083876 | A1 * | 3/2016 | Thiel | D03D 13/004 139/11 |
| 2018/0179675 | A1 * | 6/2018 | Rutz | D03J 1/007 |

FOREIGN PATENT DOCUMENTS

| | | | |
|---|---|---|---|
| DE | 20 2013 104 888 | U1 | 3/2015 |
| EP | 1 731 643 | A1 | 12/2006 |
| GB | 1312332 | | 4/1973 |

* cited by examiner

METHOD FOR PATTERN-DIRECTED FORMATION OF THE CONNECTION POINT OF AN EFFECT THREAD IN THE WOVEN FABRIC

This application claims priority from PCT application No. PCT/EP2020/059942 filed Apr. 7, 2020 which claims priority from European application No. EP 19168490.1 filed Apr. 10, 2019, the disclosures of which are incorporated herein by reference.

TECHNICAL FIELD

The invention relates to a method for pattern-controlled formation of the binding points of an effect thread in the woven fabric.

BACKGROUND OF THE INVENTION

The introduction of effect threads into a woven fabric by means of laying needles, which are stitched into the open reed from above between the reed beat-up and the reed, whereby an effect thread loop is brought into the lower shed, has been known—for example from CH 490 541 A— for a long time. However, this has revealed the problem that the effect thread needle is not always stitched precisely into the desired warp thread gap, but rather into an adjacent warp thread gap. This can be due to var-ious reasons, for example vibration of the woven material or of the effect thread needle, in particular at higher weaving speeds, but also to a differing quality of the warp threads.

DE 20 2013 104 888 U1 discloses a through-flowable clothing for paper or pulp de-watering machines, whereby in a certain embodiment—shown in FIG. 4 of DE 20 2013 104 888 U1—according to the pattern repeat used, already the base weft threads are each woven over several base warp threads—that means in a certain floating manner—although uniformly over the entire woven fabric. In this embodiment of DE 20 2013 104 888 U1, additional warp threads are then introduced which there-after—in the said embodiment—extend in a long floating manner over several base weft threads parallel to the base warp threads. Therefore, the described embodiment of DE 20 2013 104 888 U1 does not provide an approach to solving the above-described problem that the effect thread needle is not always stitched precisely into the desired warp thread gap, but rather into an adjacent warp thread gap, whereby it is also not apparent that such a problem would be at all significant in the application of the woven fabric of DE 20 2013 104 888 U1.

In EP 1 731 643 A1 a woven fabric is disclosed as a membrane for a loudspeaker, in which a conductive thread is incorporated, for example, in a meandering manner, wherein this conductive thread is positioned at the points at which it expands parallel to the respective adjacent warp threads in the manner of a replacement for each one of the warp threads. In any case, EP 1 731 643 A1 does not disclose any measures for solving the above-described problem that the effect thread needle is not always stitched precisely into the desired warp thread gap, but at most into an adjacent warp thread gap, whereby it is also not apparent that such a problem would be at all significant when applying the teaching of EP 1 731 643 A1.

SUMMARY OF THE INVENTION

An object of the invention is to propose a manufacturing process in which the binding of the effect thread is precise in the sense that the aforementioned uncertainty as to whether it is precisely stitched between two warp threads or closely beside them is irrelevant. The object is achieved by a manufacturing process. Thereby, the measures of the invention initially result in the fact that the weft thread, which is intended to bind the effect thread, floats over a certain length thereof over warp threads, i.e. it is shot over a certain number of warp threads. In the sense of this invention, float is to be understood as the region of the respective weft thread which has been introduced over several warp threads, without being arranged underneath one of the warp threads. The length of the float can be specified as a geometric length, for example 1 mm, or as a certain number of warp threads, that means for example, at least 6. Due to the fact that the effect needle is stitched within the floating weft thread length, the effect thread slips to the respective end of the floating weft thread length after the binding step, or possibly in one of the subsequent cycles. As the two ends of the floating weft thread lengths are uniquely defined by the woven fabric construction, the binding point of the effect thread is thus also precisely defined.

The method of the present invention can be used in a particularly advantageous mat-s ter when, in a woven fabric which is to be cut into individual woven fabric strips during the manufacturing process, subsequent fraying is to be prevented from the outset by incorporating zigzag structures, which are then cut in a further step with a cold knife or a tool having the same effect. Thereby, warp threads that are lying loosely between the zigzag structure of the cover threads or the effect threads and the cutting edge in the woven fabric, are simply pulled off subsequently. If the effect thread needle is not always stitched precisely into the desired warp thread gap, it can hap-pen that the warp threads lying next to the zigzag stitch are—in one case—over-stiched by the zigzag stitch and—in another case—are lying freely. As a result, a continuous drawing off of the warp threads is not possible or more difficult and the threads may get caught and break at the points where they are stitched. The measures of the invention in this advantageous application solve the problem by vir-tue of the fact that the weft threads float over a certain weft thread length between the edge-sided binding points of two adjacent zigzag lines. If the measures of the invention are applied, the needles that bring the zigzag stitch into the shed from the top only need to stitch somewhere within the floating weft thread region. This is because the binding point of the zigzag thread automatically slips to the desired position, at the latest when the subsequent stitching process is carried out.

A further advantageous application of the present invention is achieved by the fact that when having two—preferably also zigzag shaped—effect threads, stitches are applied at certain points in such manner that the two threads touch each other at certain points of the woven fabric. On the one hand, this can enable certain optical effects. On the other hand, it is also possible to form effect threads as conductor threads—namely as metal threads or metal-coated textile threads, and to then provide very specific, precise points at which the two conductor threads touch and thus have an electrical connection. Of course, this can occur over the length of the woven fabric at a wide variety of points, possibly only once or twice over the entire length of the woven fabric, or else even at each zigzag. Particularly in the case of labels which are provided with electrical elements such as sensors or microprocessors, a specific conductive pattern can be made possible, particularly if more than two conductive effect threads are incorporated. It should be emphasized in this connection that the conductive effect threads do not necessarily have to be incorporated in a zigzag manner, but rather can be, for example, meander-shaped over long distances, in which case the float according to the invention is provided only at the point of contact.

In one application of the invention, a textile woven fabric is produced which has the property of a textile circuit board. In this case, the woven fabric is woven in multiple layers with at least several warp thread layers, wherein one of the warp thread layers has conductive threads, that is metal threads or, for example, threads metallized at the surface. It is possible for the application described here that all or only certain warp threads of such warp thread layer exhibit the conductive property. Moreover, certain weft threads have such a conductive property. Thereby, the woven fabric is initially laid out in such manner that the conductive weft threads and the conductive warp threads do not touch each other, as they are separated from each other, for example, by a non-conductive warp thread layer. However, the conductive weft threads and the conductive warp threads are brought into contact among each other by the cover threads, which themselves are non-conductive. In this application, the position of the binding point is determined precisely by the fact that, due to the float in the woven fabric, the cover thread slips exactly to the point at which the electrical connection is intended. Once such a contact point of the conductive weft threads with the conductive warp threads has been established in the woven fabric, the cover thread is guided to the next intended contact point and stitched there. Applications of this design are manifold. On the one hand, antenna loops can be considered which are incorporated into a textile woven fabric and which—after the application, for example, of an RFID chip—form an RFID textile (for example, a label). On the other hand, this aspect of the invention can also be used to form a heating textile or an induction loop for charging batteries or for wireless transmission of data.

Further advantageous embodiments of the weaving loom are described herein.

The aforementioned elements, as well as those claimed and described in the following exemplary embodiments, to be used according to the invention, are not subject to any particular conditions by way of exclusion in terms of their size, shape, use of material and technical design, with the result that the selection criteria known in the respective field of application can be used without restrictions.

BRIEF DESCRIPTION OF THE DRAWINGS

Examples of the weaving loom will henceforth be described in more detail by reference to the drawings, which show.

DETAILED DESCRIPTION OF THE PREFERRED EMBODIMENTS OF THE INVENTION

Figure 1:
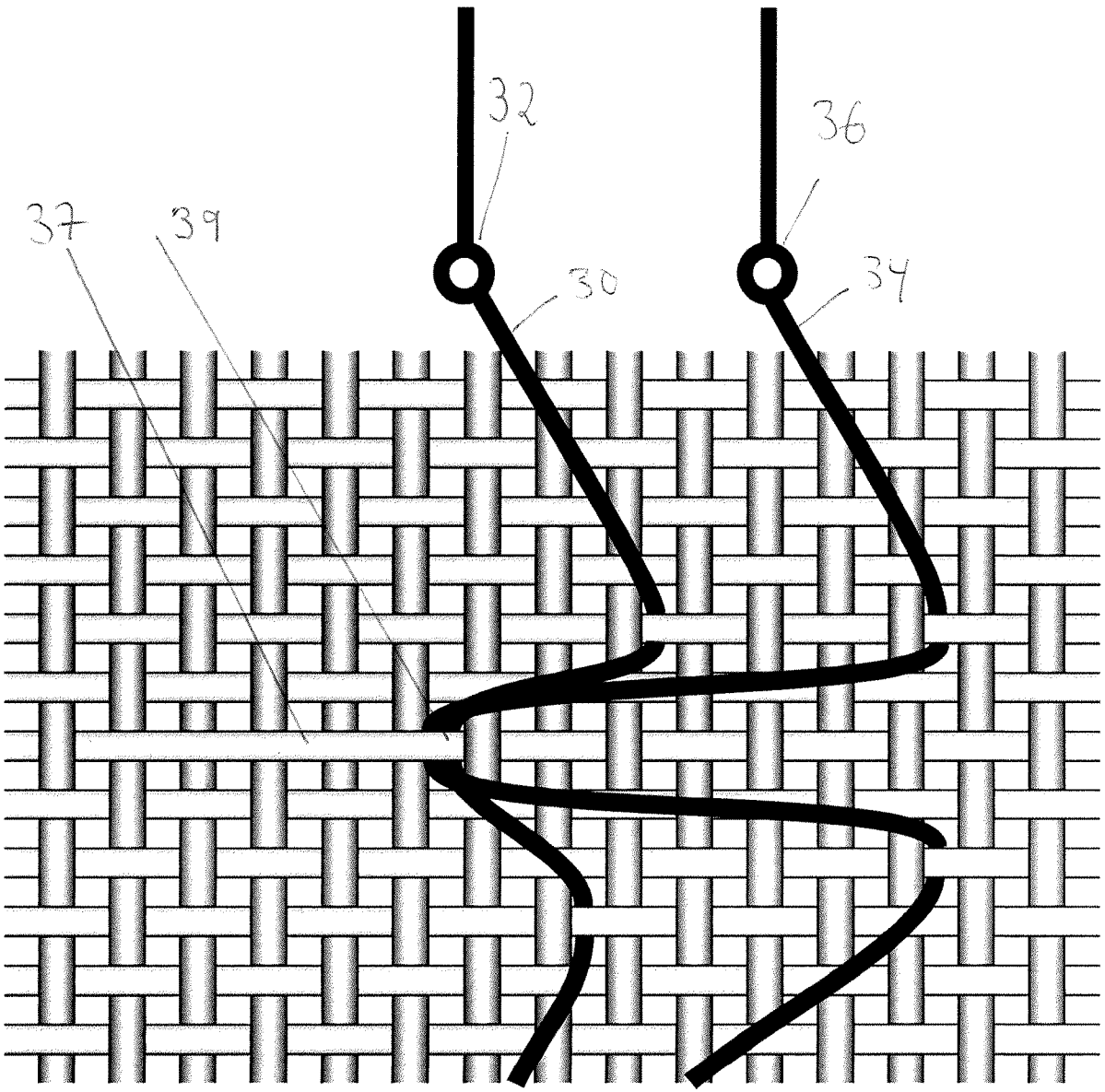
FIG. 1 a first form of application of the present invention, in which two cover threads introduced in a zigzag manner are positioned so as to be in contact with each other at specific points, FIG. 2 a further form of application of the present invention, in which for two oppositely positioned cover threads introduced in a zigzag manner it is ensured that the end points of the zigzag shape are positioned in each case on a line in the direction of the warp thread, FIG. 3 an embodiment of the application of the present invention shown in FIG. 2 with additional securing of the cover threads at the zigzag end points after cutting of the woven fabric, FIG. 4 the binding for the execution of an alternative, very reliable cold cutting edge, FIG. 5 the woven fabric according to FIG. 4, as it is presented on the loom, FIG. 6 an example of application of the present invention for producing textile conductor surfaces, FIG. 7 a textile heating tape, produced by means of the measures of the present invention, for comparatively large heating power, FIG. 8 a textile heating tape, produced by means of the measures of the present invention, for comparatively small heating power, and FIG. 9 a detailed representation regarding FIGS. 7 and 8, respectively.

FIG. 1 shows a first application of the present invention. In this application, it shall be ensured that two adjacently introduced, zigzag-shaped additional threads 30 and 34 touch each other at precisely defined points 39. In this context, it should be noted that, on the one hand, it is difficult or even impossible to have two feed needles stitched at the same position, since they would interfere with each other. But as shown in FIG. 1, the two feed needles 32 and 36 can, in principle, be introduced anywhere within the float region, since they each slip to the end point of the float where they become firmly positioned due to the zigzag shape and the associated tension. The effect of mutual contact is thus achieved—by the measures of the invention—already by the fact that the two laying needles stitch in the region of the float 37. In a first, simple application, optical effects are achieved with this measure when the cover threads 30, 34 stand out optically from the base woven fabric (warp and weft). In a further application, however, electrical contact points can also be produced with the aforementioned measure, provided that the cover threads are, for example, metal threads or metallized textile threads. In this way, textile circuit boards can be produced, for example, by the fact that the conductor threads later are equipped with electronic or electrical components (e.g. sensors or microprocessors).

Figure 2:
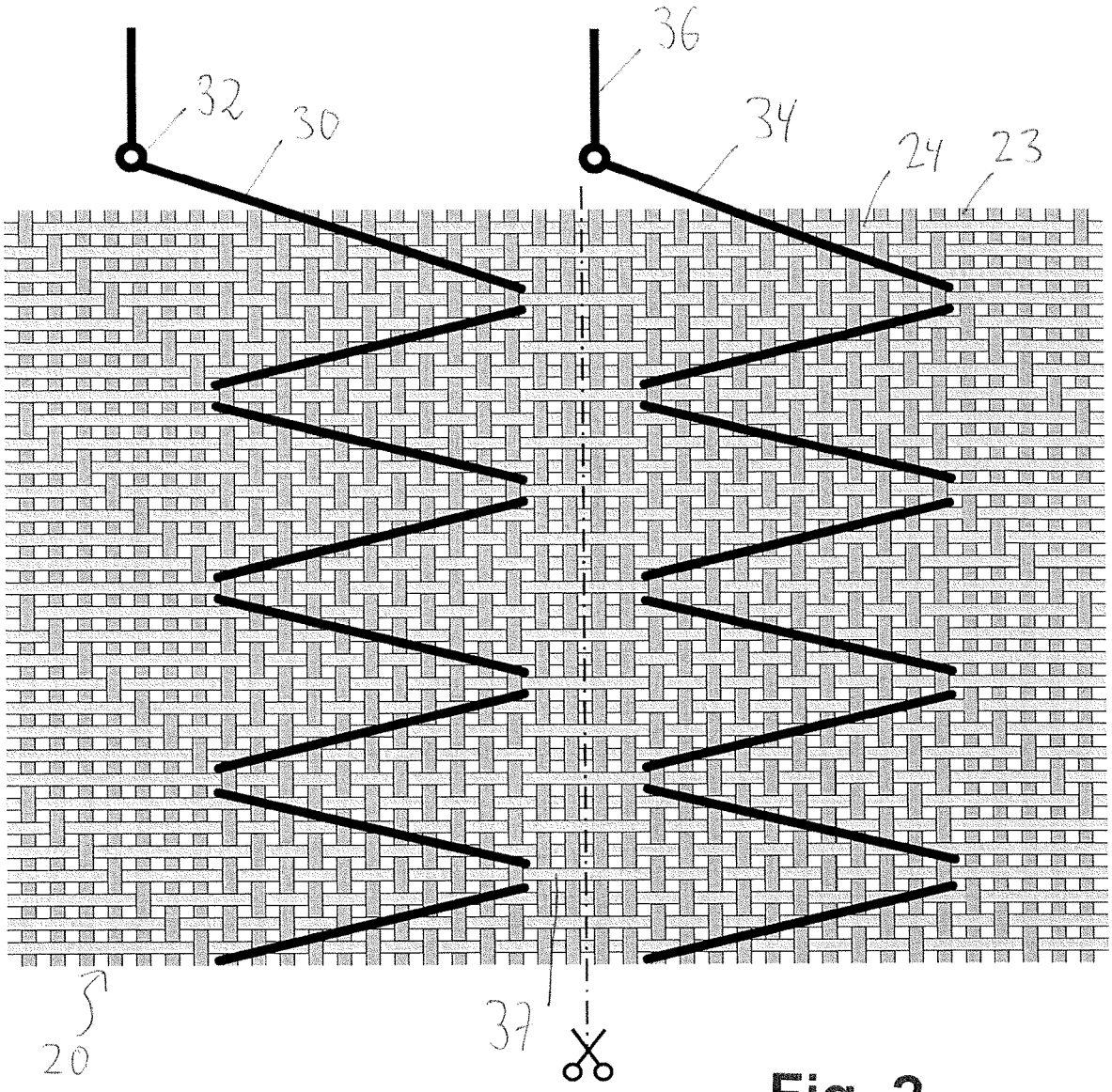

FIG. 2 shows a completely different application of the present invention, in which, in a woven fabric which is to be cut into individual woven fabric strips during the manufacturing process, subsequent fraying is to be prevented from the outset by the incorporation of zigzag structures, which are then cut in a further step with a cold knife or a tool having the same effect. Thereby, warp threads that are lying loosely between the zigzag structure of the cover threads or the effect threads and the cutting edge in the woven fabric, are simply pulled off subsequently. Thereby, the float prevents the zigzag binding point which lies on the side of the cutting line from not always lying exactly in the same warp thread gap, and the warp threads which lie next to the zigzag stitch from being overstitched by the zigzag stitch in one case and lying freely in another case. The float ensures a continuous drawing off of the warp threads. And it is prevented, that the warp threads get caught and break. The measures of the invention in this advantageous application solve the problem by vir-tue of the fact that the weft threads 24 float over a certain weft thread length between the edge-sided binding points of two adjacent zigzag lines. The needles that bring the zigzag stitch into the shed from above, only need to stitch somewhere within the floating weft thread region. The joining or binding point of the zigzag thread automatically slips to the desired position, that is, to the respective warp thread 23*a*, 23*b*, 23*c*, 23*d*, at the latest when the subsequent stitching process is carried out.

Figure 3:
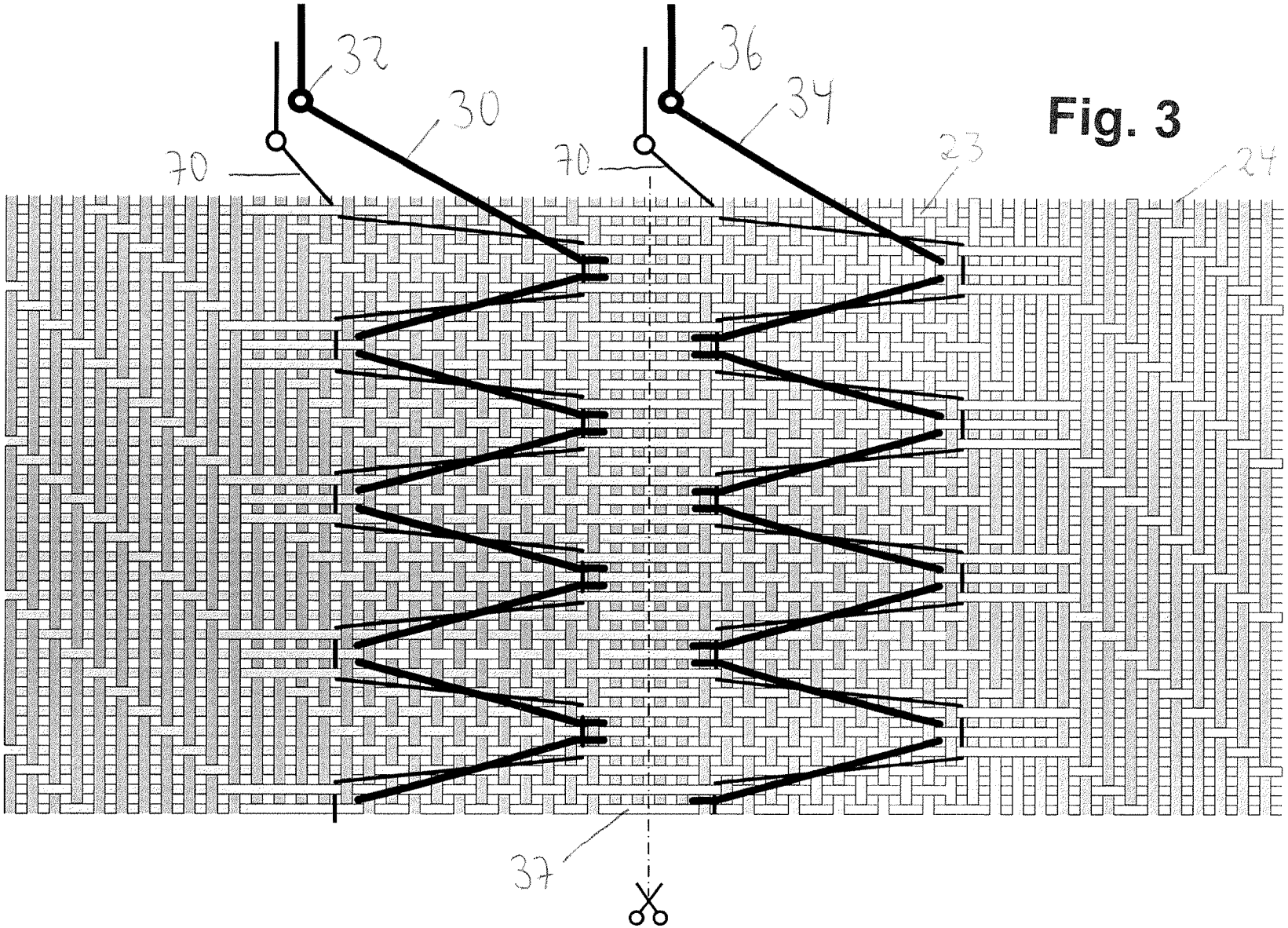

FIG. 3 shows an improved embodiment corresponding to FIG. 2, in which the zigzag thread is fixed by means of an additional cover thread 70 so that the weft thread cannot slip out of the zigzag point after cutting. This would be possible, for example, when washing the woven fabric or the cut woven fabric tape, or in the case of rough or improper handling. It should be noted that the additional cover thread 70 can certainly be inserted so as to be displaced inwardly by one warp thread (with respect to the zigzag shape), and it will still tie off the cover thread 30, 34 in such manner that the weft thread cannot slip out after cutting.

Figure 4:
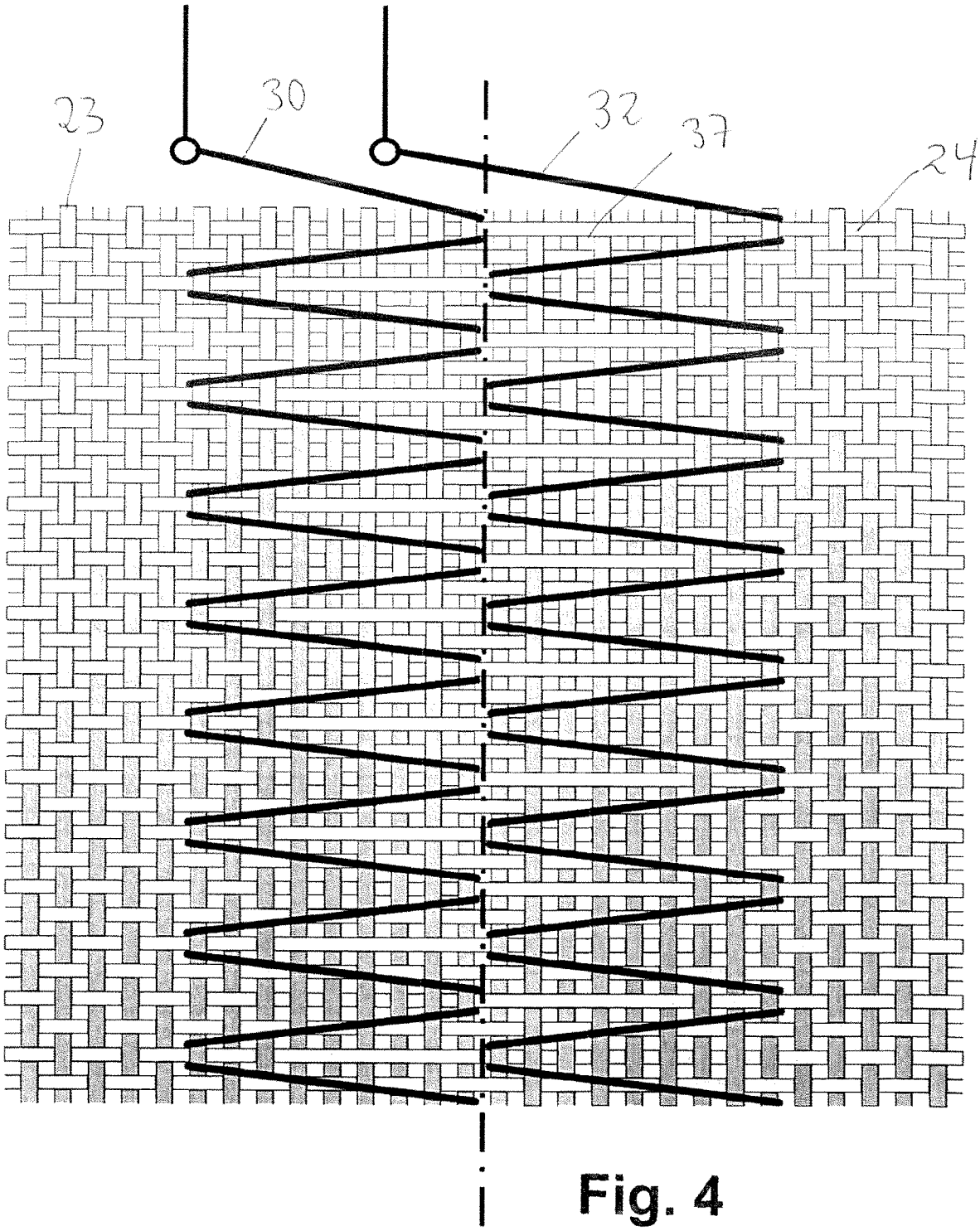
Figure 5:
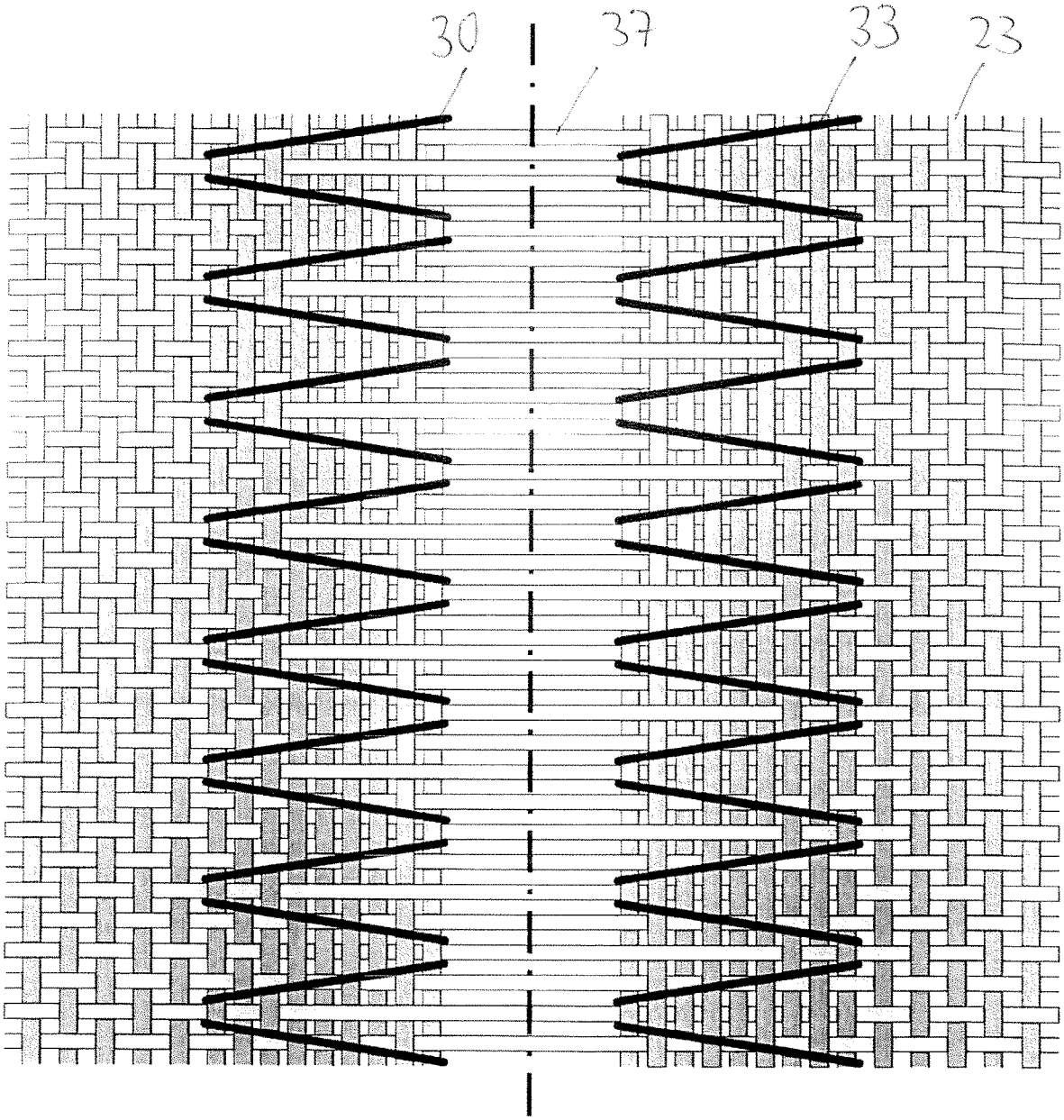

FIGS. 4 and 5 show another embodiment of the present invention for the purpose of a reliable cold cutting edge which has proved to be particularly reliable in practical tests. In this embodiment, the removal of excess warp threads is omitted. FIG. 4 shows the binding and FIG. 5 shows the woven fabric as it is presented on the weaving loom. During the binding process, floating threads ensure that the zigzag threads always dip precisely into the correct warp thread gap. Since the zigzag threads are under tension, the warp threads being overstitched by them slip together and form a kind of bundle at the edges. These are so tight that the binding points no longer slip, and the edges therefore become fray-proof. By varying the tension of the zigzag threads, the width of the cutting path or the length of the weft thread tails exposed after cold cutting can be adjusted.

Figure 6:
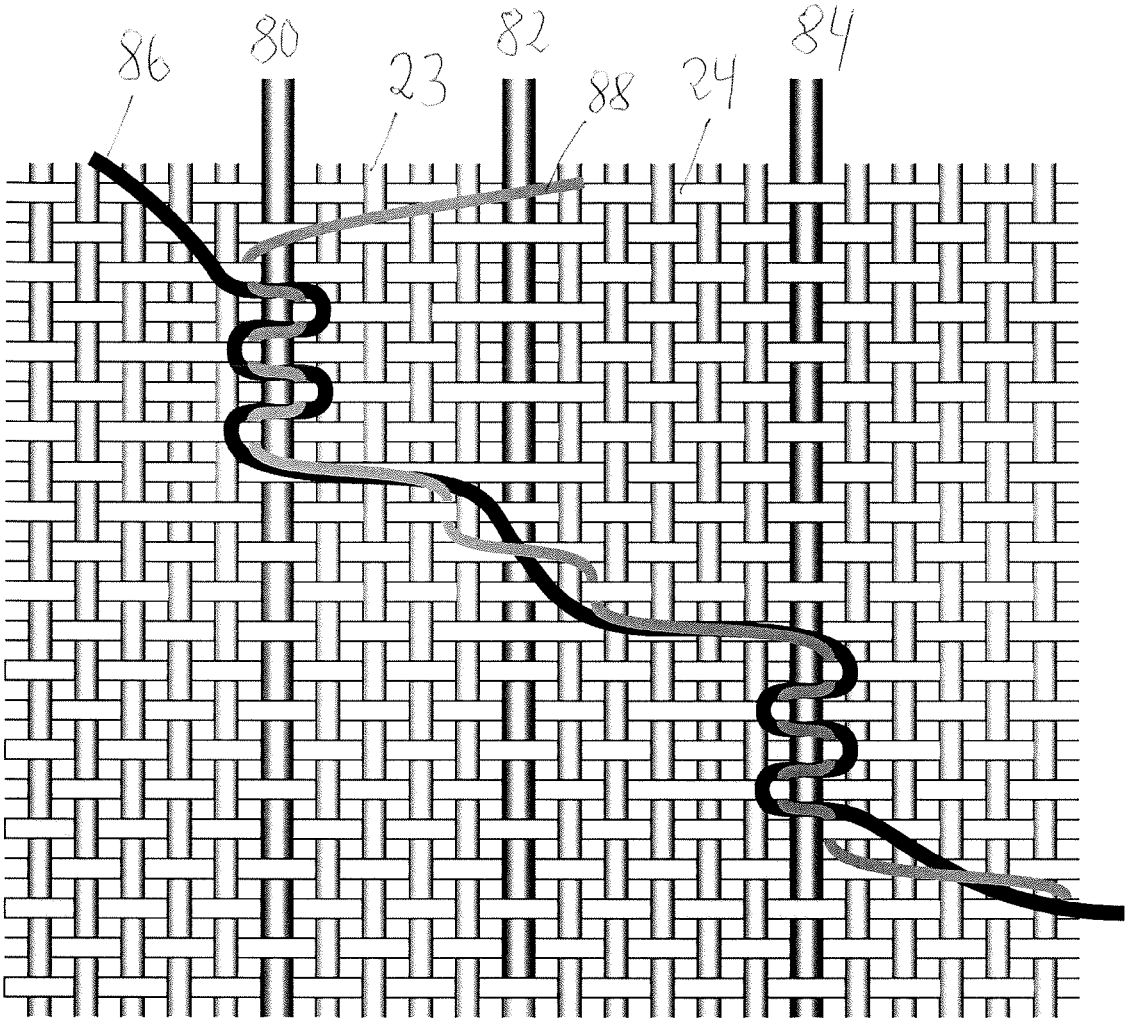

Another application—shown by means of FIG. 6—also concerns textile woven fab-rics that are provided as textile printed circuit boards. In this application, the woven fabric is woven in such manner that at least one warp thread layer comprises conductive threads, that is metal threads or, for example, threads metallized at the surface. In the illustrated embodiment, three non-insulated conductive threads 80, 82 and 84, e.g. copper strands, lie in the warp. A non-isolated conductive thread 86 is placed on the woven fabric by means of laying needle and attached by means of a textile thread 88, which in turn is bound into the woven fabric. The textile thread 88 is stitched in the neighborhood of the contact points between conductive warp thread 80 and the laid-on conductor 86, exactly into the warp gap on the left and right of the conductive warp thread. This is made possible by the float of the corresponding weft threads over 2 to 3 warp threads. The central conductive warp thread 82 should not be contacted with the conductor 86. Therefore, the laid-on conductor 86 lies above the weft threads 24 at the crossing point, whereas the conductive warp thread 84 lies below the weft threads. The weft threads 24 are located between the two conductors 82 and 86 and thus form an insulating layer. In order to prevent the laid-on conductor from slipping into a region in which the conductive warp thread 82 lies above the weft thread, it is loosely tied by means of the auxiliary thread 88 at the contactless crossing point.

Figure 7:
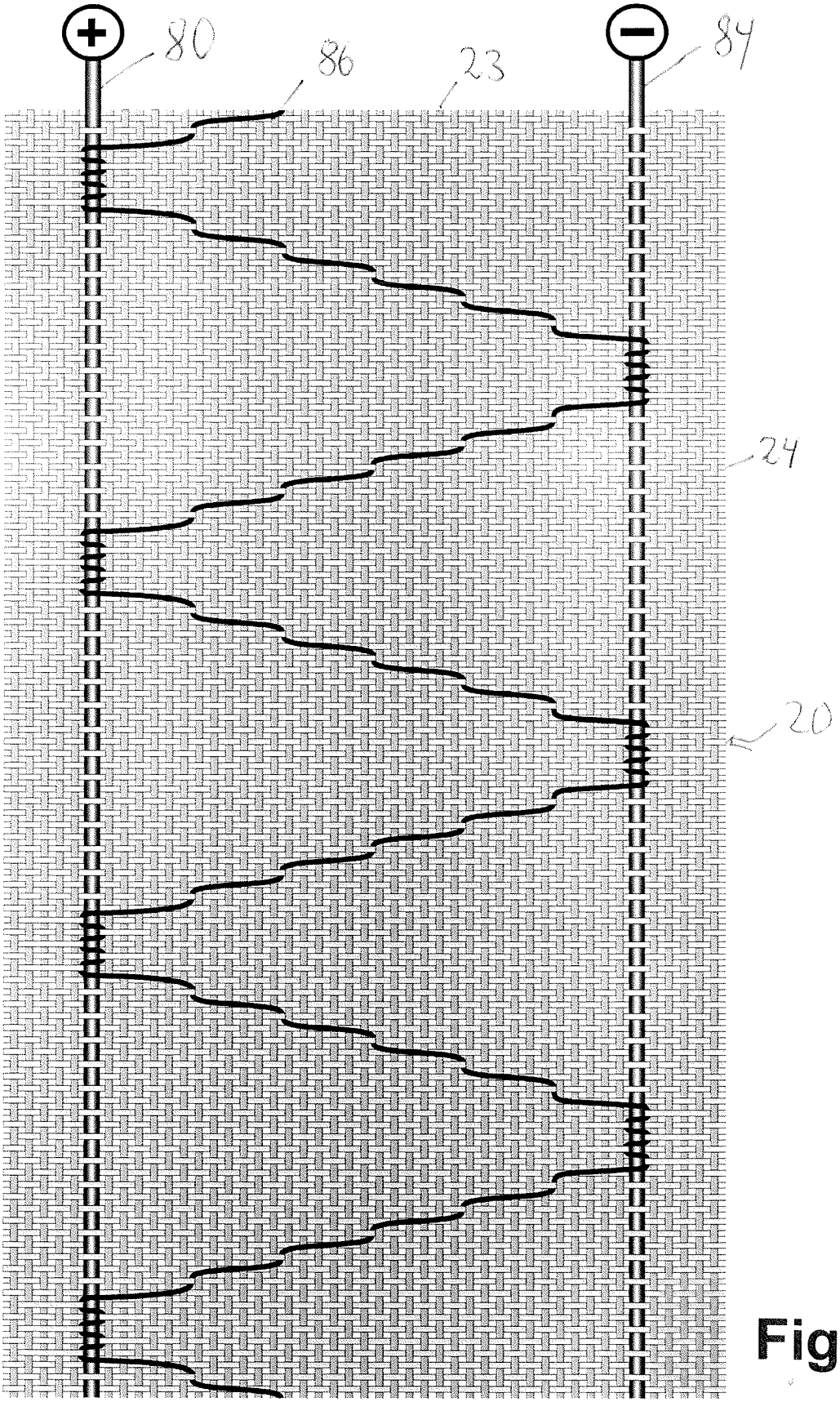
Figure 8:
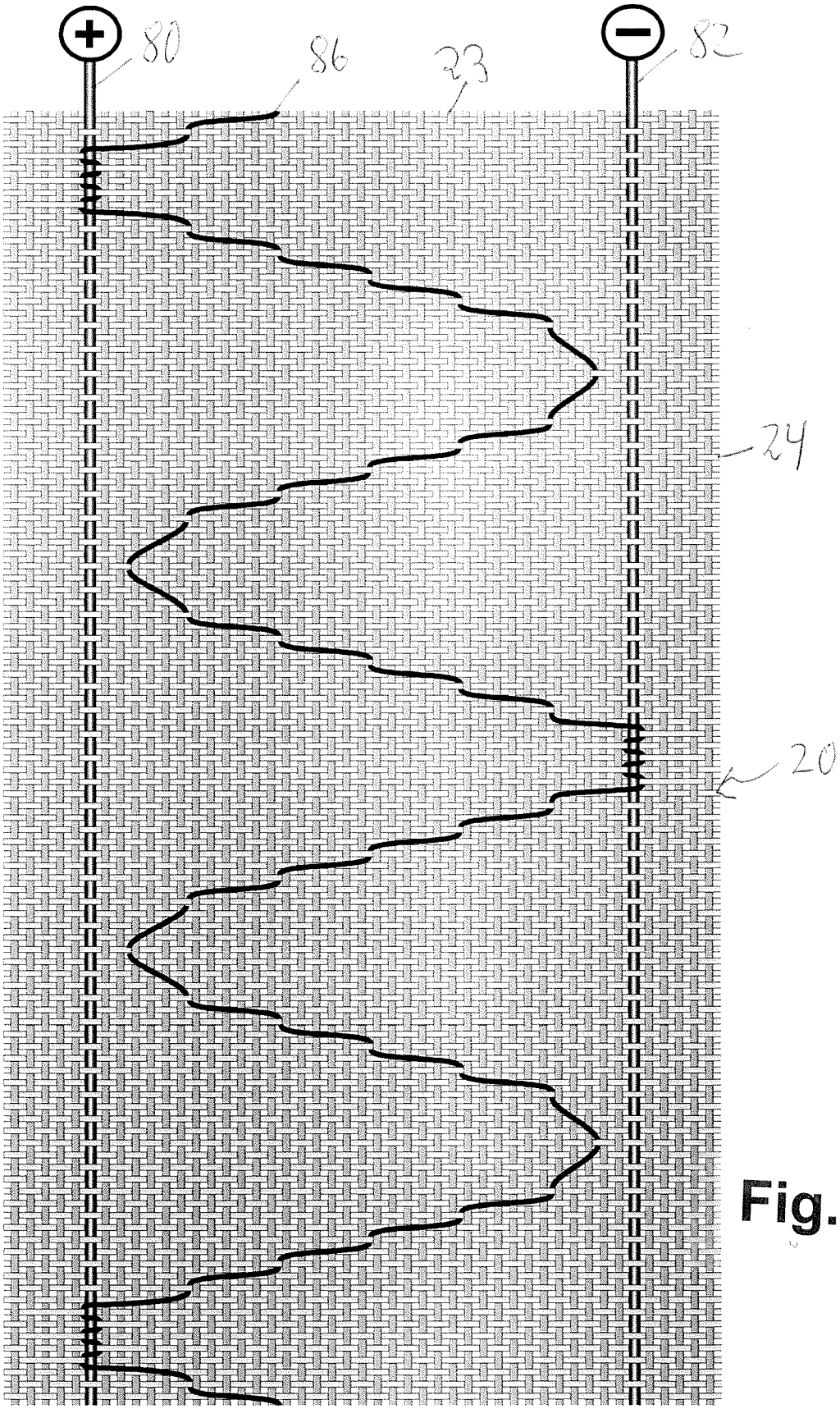
Figure 9:
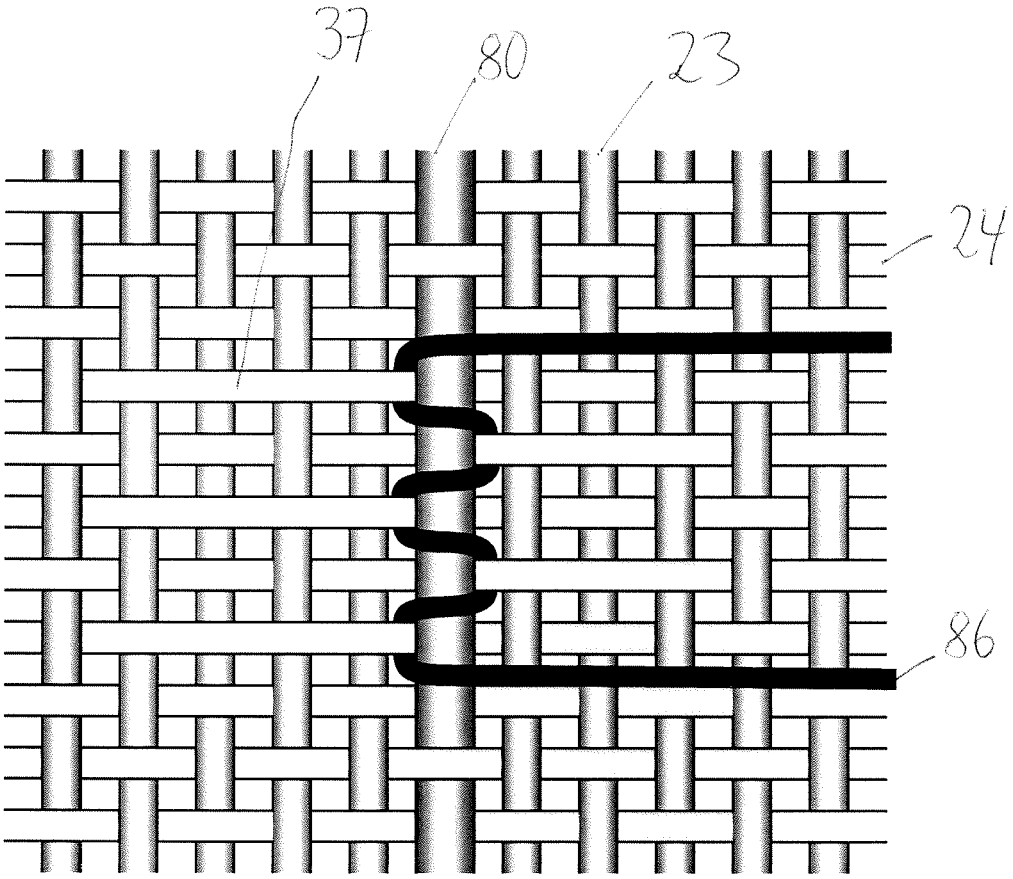

A further application of the present invention relates to the formation of a textile heating tape, shown by means of FIGS. 7 to 9. The supply of electrical power takes place via two conductive warp thread 80 and 84 in the region of the fabric edges. The heating effect is generated by means of a laid-out heating conductor 86, which is disposed as a conductive cover thread. The conductor 86 connects two respective conductive warp threads 80 and 84, which connect the two power supply threads. For larger heating power, the length of the heating conductor 86 is short; for smaller heating power it is lengthened by being disposed in a meandering manner. This allows variation of the heating power in any desired manner along the length of the tape. In addition, if a heating conductor 86 breaks, the entire heating system does not fail but will only fail in a small region. The contact point between the conductive warp threads 80 and 84 and the laid-out heating conductor 86 is accomplished—as shown in FIG. 9—by stitching the heating conductor 86 into the warp gap alternatingly to the left and right of the conductive warp thread 80 and 84. This creates an intensive and se-cure electrical connection between the respective conductive warp thread 80 or 84 and the heating conductor 86. Here, too—just by applying the measures of the present invention—it is ensured by means of floating weft threads that the heating conductor 86 always stitches into the correct warp gap.

LIST OF REFERENCE NUMERALS

20 woven fabric
23 warp threads
23*a*, 23*b*, 24*c*, 24*d* warp thread, on which the cover thread is positioned
24 weft thread
30 first cover thread
32 first feed needle
34 second cover thread
36 second feed needle
113 37 float region
39 point of contact
70 additional cover thread for attaching the zigzag thread
80 conductive warp thread
82 conductive warp thread
84 conductive warp thread
86 conductive cover thread
88 non-conductive cover thread (auxiliary cover thread)

The invention claimed is:

1. A method for producing a woven fabric by means of a weaving loom, wherein the weaving loom comprises at least a weft thread insertion device, a reed or an equivalent means, at least a laying device with a feed needle for at least one cover thread, comprising the steps of inserting weft threads into an open warp thread shed, laying the cover thread or the cover threads by means of the feed needle or feed needles, wherein the weft thread is introduced at certain points in the woven fabric over a plurality of adjacent warp threads in a floating manner, and at least one cover thread is positioned, by means of at least one feed needle, underneath the floating weft thread and is thereby tied in by the floating weft thread, characterized in that the said cover thread is positioned under the floating weft thread at an arbitrary point between opposing ends of a floating weft thread region and is thereby tied in by the floating weft thread, whereby, when the said cover thread is placed under tension, the said cover thread slips to a precise position at one end of the floating weft thread region.

2. The method according to claim 1, characterized in that at least one feed needle introduces a cover thread into the woven fabric in a zigzag manner, wherein the weft threads, on which joining or binding points of the cover threads are to be positioned, float over a plurality of adjacent warp threads in such manner that the said cover threads are each positioned on the same warp thread in the woven fabric in order to form a zigzag structure.

3. The method according to claim 2 characterized in that at least two zigzag structures are configured in the woven fabric by means of at least two feed needles and by means of at least two cover threads in such manner that the two zigzag structures do not overlap.

4. The method according to claim 2, characterized in that in addition to the said cover threads each being introduced in a zigzag manner, a further cover thread is introduced by means of a further feed needle in such manner that the further cover thread binds the said zigzag cover threads opposite a respective weft thread at a zigzag end point.

5. The method according to claim 2, characterized by a further step of cutting the woven fabric in take-off direction into a plurality of fabric strips by means of a cutting device, wherein a cutting line in a region between two opposite zigzag points is selected in such manner that the said floating weft threads are cut in a region above the warp threads.

6. The method according to claim 5, characterized in that superfluous warp threads in front of or behind the reed are drawn off.

7. The method according to claim 5, characterized in that the warp threads are drawn together in a cut edge region by a predetermined tension of the cover threads, whereby weft thread tails become exposed.

8. The method according to claim 5, characterized in that two opposing zigzag points are bound in a common warp gap, whereby a drawing off of superfluous warp threads is unnecessary.

9. The method according to claim 1, wherein the woven fabric is a textile circuit board, characterized in that at least one warp thread layer comprises conductive threads, and that at least one non-insulated conductive thread is laid onto the woven fabric by means of a laying needle and is attached by means of a textile thread, which in turn is bound into the woven fabric.

10. The method according to claim 9, characterized in that the said textile thread forms a contact between the conductive warp threads and the non-insulated conductor thread.

11. The method according to claim 9, characterized in that the weft threads form an insulating layer between a conductive warp thread and the non-insulated conductor thread.

12. The method according to claim 11, characterized in that the said textile thread loosely ties the non-insulated conductor thread.

13. The method according to claim 12, characterized in that the woven fabric is a textile heating tape, wherein power is supplied via two conductive warp threads in a region of the fabric edges and a heating effect is generated by means of a laid heating conductor that is laid as a conductive cover thread, wherein the heating conductor connects the two conductive warp threads.

14. The method according to claim 13, characterized in that a heating power level of the conductive cover thread is freely selected depending on the conductive cover thread's free length between two connection points with the two conductive warp threads.

15. The method according to claim 1, characterized in that at least two feed needles each introduce a cover thread into the woven fabric in a zigzag manner so that these two cover threads are positioned at the same point in the woven fabric at least on one side of the zigzag cover threads.

16. The method according to claim 3, characterized in that in addition to the said cover threads each being introduced in a zigzag manner, a further cover thread is introduced by means of a further feed needle in such manner that the further cover thread binds the said zigzag thread opposite a respective weft thread at the zigzag end point.

17. The method according to claim 3, characterized by a further step of cutting the woven fabric in take-off direction into a plurality of fabric strips by means of a cutting device, wherein a cutting line in a region between two opposite zigzag points is selected in such manner that the said floating weft threads are cut in a region above the warp threads.

18. The method according to claim 4, characterized by a further step of cutting the woven fabric in take-off direction into a plurality of fabric strips by means of a cutting device, wherein a cutting line in a region between two opposite zigzag points is selected in such manner that the said floating weft threads are cut in a region above the warp threads.

19. The method according to claim 10, characterized in that the weft threads form an insulating layer between a conductive warp thread and the non-insulated conductor thread.

20. The method according to claim 2, characterized in that at least two feed needles each introduce a cover thread into the woven fabric in a zigzag manner so that these two cover threads are positioned at a common point in the woven fabric at least on one side of the zigzag cover threads.

* * * * *